US007243710B2

(12) United States Patent
Shinhama

(10) Patent No.: US 7,243,710 B2
(45) Date of Patent: Jul. 17, 2007

(54) VEHICLE HEAT EXCHANGER

(75) Inventor: Masayoshi Shinhama, Sano (JP)

(73) Assignee: Calsonic Kansei Corporation (JP)

( * ) Notice: Subject to any disclaimer, the term of this patent is extended or adjusted under 35 U.S.C. 154(b) by 0 days.

(21) Appl. No.: 10/807,962

(22) Filed: Mar. 24, 2004

(65) Prior Publication Data

US 2004/0206483 A1 Oct. 21, 2004

(30) Foreign Application Priority Data

Mar. 31, 2003 (JP) ..... 2003-096676

(51) Int. Cl.
*F28D 7/10* (2006.01)
*B60K 11/04* (2006.01)

(52) U.S. Cl. ..... 165/140; 165/132; 165/67

(58) Field of Classification Search ..... 165/140, 165/132, 148, 110, 172, 177, 42, 67, 151, 165/152; 62/507, 509; 180/68.4
See application file for complete search history.

(56) References Cited

U.S. PATENT DOCUMENTS 5,159,821 A * 11/1992 Nakamura ..... 62/509
5,505,253 A * 4/1996 Heraud ..... 165/110
5,875,836 A * 3/1999 Nakamura ..... 165/122
6,273,184 B1 * 8/2001 Nishishita ..... 165/140
6,595,272 B1 * 7/2003 Uchikawa et al. ..... 165/134.1
6,607,025 B2 * 8/2003 Gille ..... 165/140
2004/0094288 A1 * 5/2004 Hoyle ..... 165/41

FOREIGN PATENT DOCUMENTS

JP 10103893 A * 4/1998
JP 10-267467 10/1998
JP 11129736 A * 5/1999
JP 11153395 A * 6/1999
JP 2002052923 A * 2/2002
JP 2002081886 A * 3/2002
JP 2002137626 A * 5/2002

* cited by examiner

*Primary Examiner*—Tho Duong
(74) *Attorney, Agent, or Firm*—Kilpatrick Stockton LLP

(57) ABSTRACT

A vehicle heat exchanger includes heat exchangers overlapped with each other in an airflow direction. The heat exchangers include heat exchanger tubes arranged side by side with each other. The heat exchangers include outer fins interposed between neighboring heat exchanger tubes. The heat exchangers includes header pipes connecting and communicating with both ends of the heat exchanger tubes for heat-conducting media to circulate through the heat exchanger tubes and header pipes. The vehicle heat exchanger includes a reservoir in communication with one of the header pipes for reserving a heat-conducting medium. The reservoir is fixed to a header pipe of the largest one of the heat exchangers.

9 Claims, 5 Drawing Sheets

10
11
14
14,24
20
21
22
24
25
26
27
28
31

VEHICLE HEAT EXCHANGER

CROSS-REFERENCE TO RELATED APPLICATIONS

This application is based upon and claims the benefit of priority from Japanese Patent Application No. 2003-096676 filed on Mar. 31, 2003; the entire contents of which are incorporated herein by reference.

BACKGROUND OF THE INVENTION

The present invention relates to a vehicle heat exchanger, with a heat-conducting medium circulating between header pipes for exchanging heat with an airflow.

A related vehicle heat exchanger is disclosed in Japanese Patent Application Laid-Open Publication No. Hei 10 (1998)-267467.

The vehicle heat exchanger includes a condenser with a liquid tank. The condenser includes a pair of headers which are spaced horizontally from each other, extending vertically. The condenser includes heat exchanger tubes which are spaced vertically from each other, extending horizontally. The heat exchanger tubes have ends in communication with one header and the opposite ends in communication with the other header. The condenser includes fins interposed between vertically neighboring heat exchanger tubes. The condenser includes partitions within said one header. The condenser includes a mounting bracket with a proximal end that is fixed by brazing on the outer circumferential surface of said one header. The condenser includes a liquid tank that is supported and fixed to the distal end of the mounting bracket. The proximal end of the mounting bracket is fixed by brazing a portion of the said one header in proximity to a plate which projects radially inwardly from the inner circumferential surface of said one header.

SUMMARY OF THE INVENTION

The present invention is directed to a vehicle heat exchanger which has a dimension reduced in a vehicle longitudinal direction. The vehicle heat exchanger allows a liquid tank to be mounted, without enlarging a bracket for mounting the liquid tank.

The invention has a first aspect directed to the following vehicle heat exchanger. The vehicle heat exchanger includes heat exchangers overlapped with each other in an airflow direction. The heat exchangers include heat exchanger tubes arranged side by side with each other. The heat exchangers include outer fins interposed between neighboring heat exchanger tubes. The heat exchangers includes header pipes connecting and communicating with both ends of the heat exchanger tubes for heat-conducting media to circulate through the heat exchanger tubes and header pipes. The vehicle heat exchanger includes a reservoir in communication with one of the header pipes for reserving a heat-conducting medium. The reservoir is fixed to a header pipe of the largest one of the heat exchangers.

The heat exchangers may include two different sized heat exchangers. A larger heat exchanger of the heat exchangers serves as a radiator configured to cool an engine-coolant water as a heat-conducting medium. A smaller heat exchanger of the heat exchangers serves as a condenser configured to cool a refrigerant as a heat-conducting medium. An airflow circulates from the condenser to the radiator. The reservoir is fixed to a header pipe of the radiator.

The reservoir may be located at the back of an intake of the frontmost one of the heat exchangers.

The neighboring heat exchangers may have header pipes having ends fixed to each other by a patch end.

The heat exchangers may have ends in directions of piling heat exchanger tubes, respectively. The ends are fixed to each other by a side plate.

The heat exchangers may have a common outer fin fixing the heat exchangers to each other.

Respective one of the neighboring heat exchangers includes corresponding one of header pipes integral with each other.

The invention has a second aspect directed to the following heat exchanger assembly. The heat exchanger assembly includes a condenser configured to condense a refrigerant by an airflow for an vehicle air conditioner. The heat exchanger assembly includes a radiator configured to cool an engine coolant by the airflow. The heat exchanger assembly has a tank for the engine coolant to circulate therethrough. The heat exchanger assembly includes a reservoir fixed to the tank back from the condenser for reserving a refrigerant condensed by the condenser.

BRIEF DESCRIPTION OF THE ACCOMPANYING DRAWINGS

FIG. 1A is an elevation view, FIG. 1B is a side view, and FIG. 1C is a top view;

DETAILED DESCRIPTION OF THE PREFERRED EMBODIMENTS

Figures 1A, 1B, 1C:
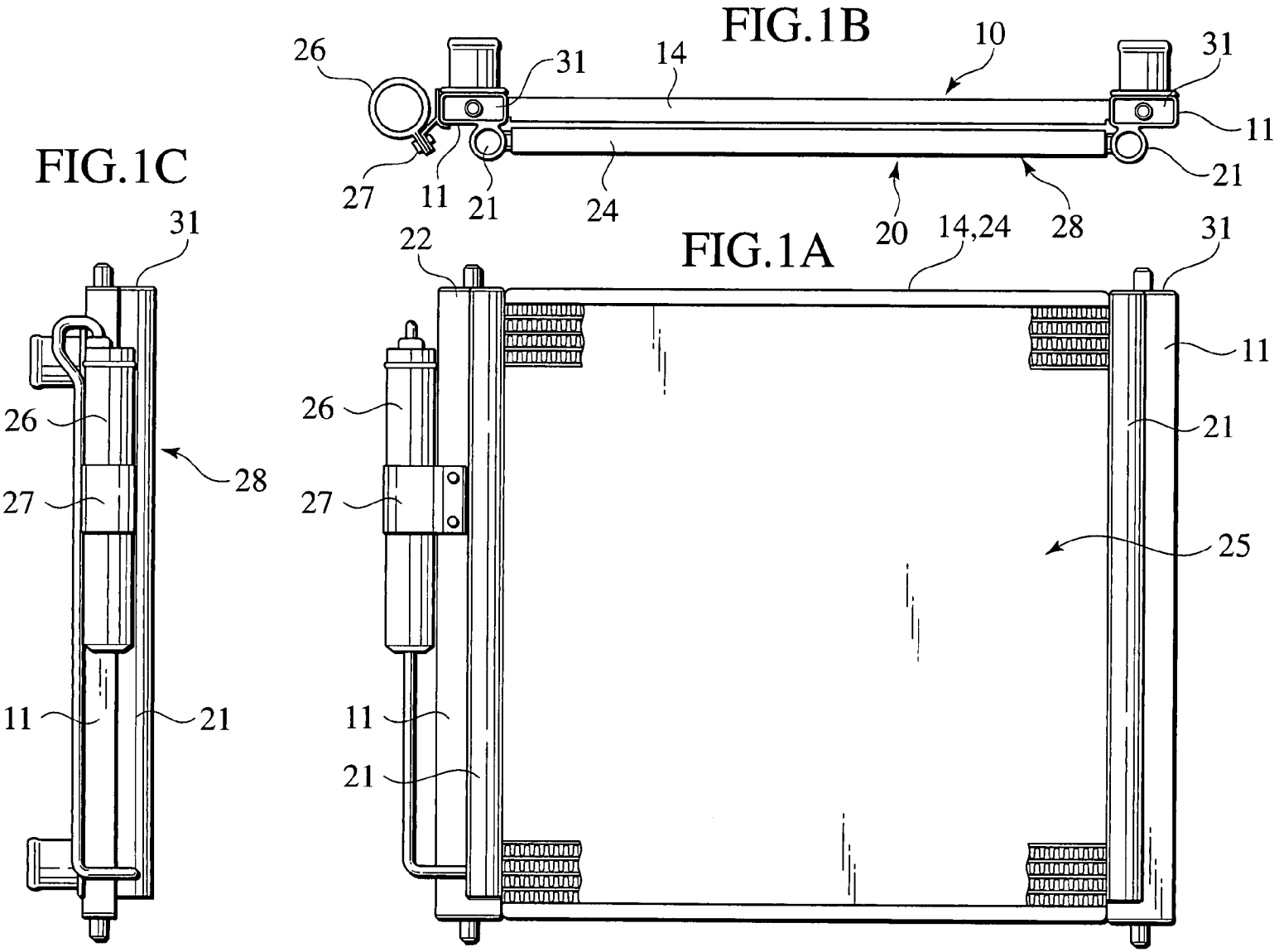
FIGS. 1A, 1B and 1C illustrate an overall view of a vehicle heat exchanger according to a first embodiment of the invention.
Figure 2:
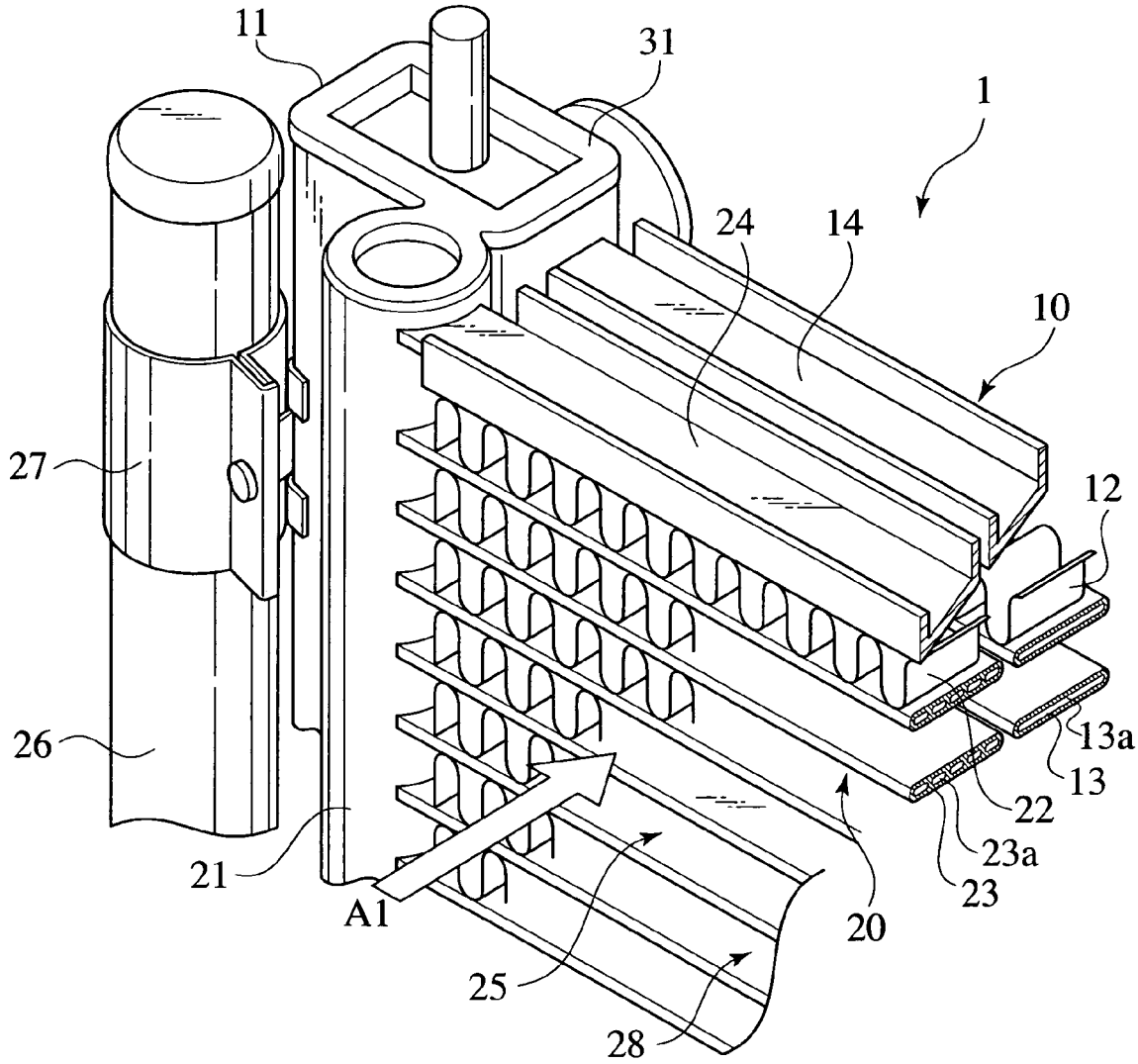
FIG. 2 is an enlarged partial perspective view of a primary portion of the vehicle heat exchanger in FIG. 1.

Embodiments of the invention will hereby be described with reference to the drawings. Like members are designated by like reference characters.

First Embodiment

In FIGS. 1A, 1B, 1C and 2, a vehicle heat exchanger 1 (referred to as a heat exchanger) has two different sized heat exchangers which are arranged along an airflow indicated by arrow A1 and are integrally overlapped with each other. The larger heat exchanger serves as a radiator 10 to cool a coolant water for an engine as a heat-conducting medium. While, the smaller heat exchanger serves as a condenser 20 to cool a refrigerant for an air conditioner as a heat-conducting medium. The vehicle heat exchanger 1 served as a cross-flow unified condenser and radiator.

The condenser 20 has a liquid tank 26 as a reservoir which temporarily reserves a condensed refrigerant. The liquid tank 26 is fixed to a header pipe 11 of radiator 10 at the back of heat-radiating-surface intake 28, using bracket 27.

The heat exchanger 1 is located at the front of an engine room of a vehicle. The radiator 10 and condenser 20 have flat tubes 13 and 23 as a heat exchanger tube both which are piled as a multistage, with corrugated outer fins 12 and 22 interposed between the tubes 13 and 23. The flat tubes 13 and 23 have circulation passages 13*a* and 23*a* between the both ends. The circulation passages 13*a* and 23*a* allow a pair of left and right vertical header pipes 11 and 21 to communicate and connect with each other. The circulation passages 13*a* and 23*a* allows a coolant water and a refrigerant to circulate therethrough. The tubes 13 and 23 have side plates 14 and 24 in a U-shaped section at the outermost ends (the top and bottom) in a piling direction. The side plates 14 and 24 are located between both header pipes 11 and 21, and reinforce tubes 13 and 23 and outer fins 12 and 22.

With the radiator 10 and condenser 20 overlapped or arranged side by side with each other, neighboring header pipes 11 and 21 have ends mounted with patch ends 31. The patch ends 31 fix radiator 10 and condenser 20 integrally to each other.

The structure allows liquid tank 26 to be mounted, without enlarging a bracket for mounting liquid tank 26, which reduces dimension in a vehicle longitudinal direction.

The condenser 20 is located at the frontmost side. The condenser 20 has heat-radiating-surface intakes 28 which have the liquid tank 26 located at the back of intakes 28 or recessed from the intakes 28. The location allows the heat exchanger 1 to be installed to a vehicle body 1, without a space in front of the heat exchanger 1. The installation allows for larger space at the back of the heat exchanger 1.

The patch end 31 fixes radiator 10 and condenser 20 to each other, which improves operability during assembling of the vehicle heat exchanger 1 to a vehicle body.

The heat exchanger 1 may use down-flow in place of the cross-flow. The out fins 12 and 22 may use plate fins in place of corrugated fins.

The operation of the vehicle heat exchanger 1 is described.

A coolant water cools an engine to flow into a header pipe 11 of radiator 10. While, a refrigerant is evaporated by an evaporator to be compressed by a compressor, flowing into a header pipe 21 of condenser 20. The coolant water and the refrigerant flow through the heat exchanger tubes 13 and 23 to exchange heat with an airflow A1 via outer fins 12 and 22, respectively. The heat exchange cools the coolant water and condenses the refrigerant. A part of the condensed refrigerant is temporarily reserved in the liquid tank 26 through the opposite header pipe 21. The remaining condensed refrigerant flows to the evaporator, while the cooled coolant water flows to the engine.

Second Embodiment

Figure 3:
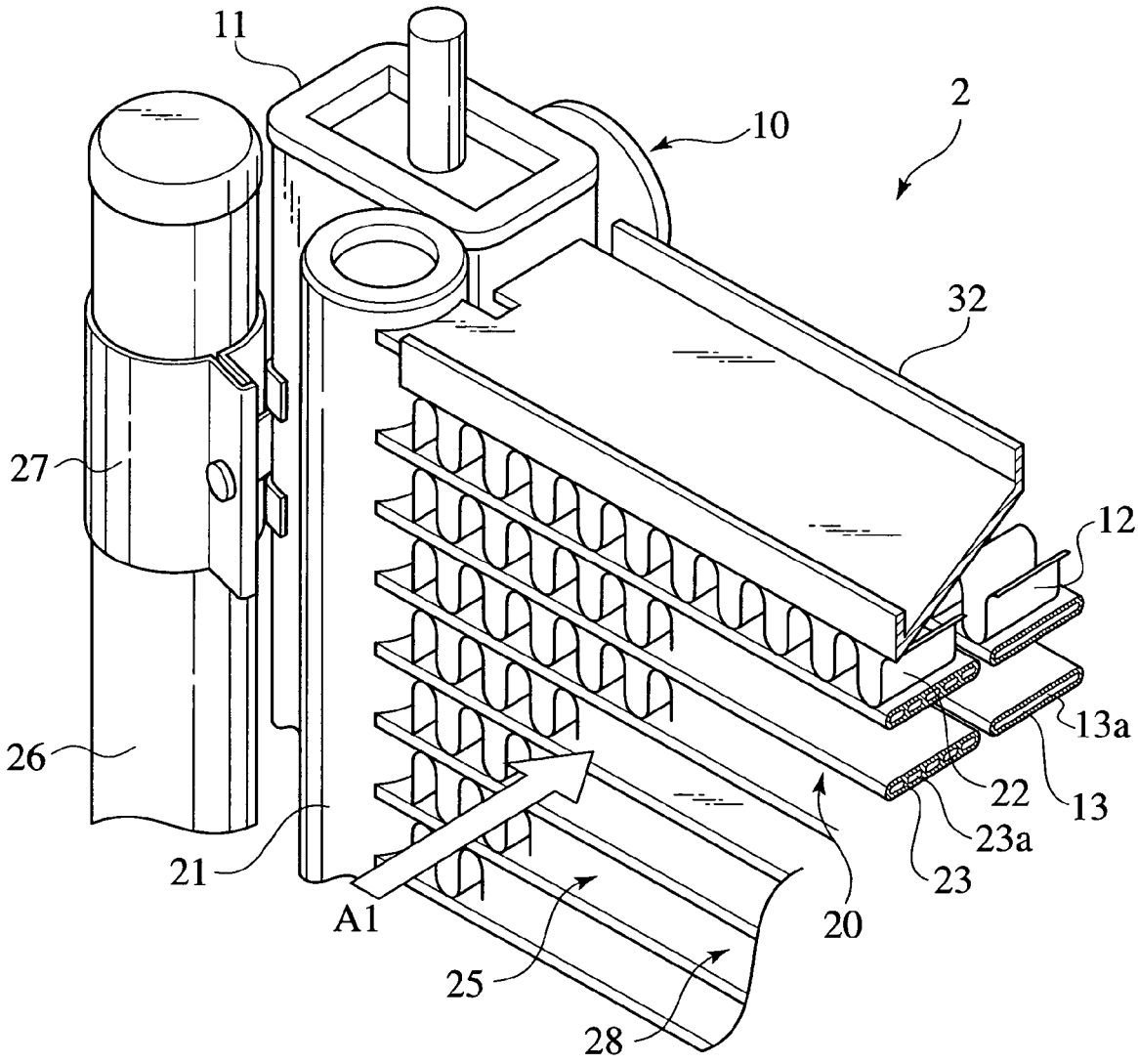
FIG. 3 is an enlarged partial perspective view of a primary portion of the vehicle heat exchanger according to a second embodiment.

With reference to FIG. 3, a vehicle heat exchanger 2 includes a side plate 32 on the top.

The side plate 32 has a U-shape and extends over outer fins 12 and 22 and flat tubes 13 and 23. The side plate 32 extends from the front ends of outer fins 22 and tubes 23 to the rear ends of outer fins 22 and tubes 23.

The side plate 32 fixes radiator 10 and condenser 20 to each other, which improves operability during assembling of the vehicle heat exchanger 1 to a vehicle body.

Third Embodiment

Figure 4:
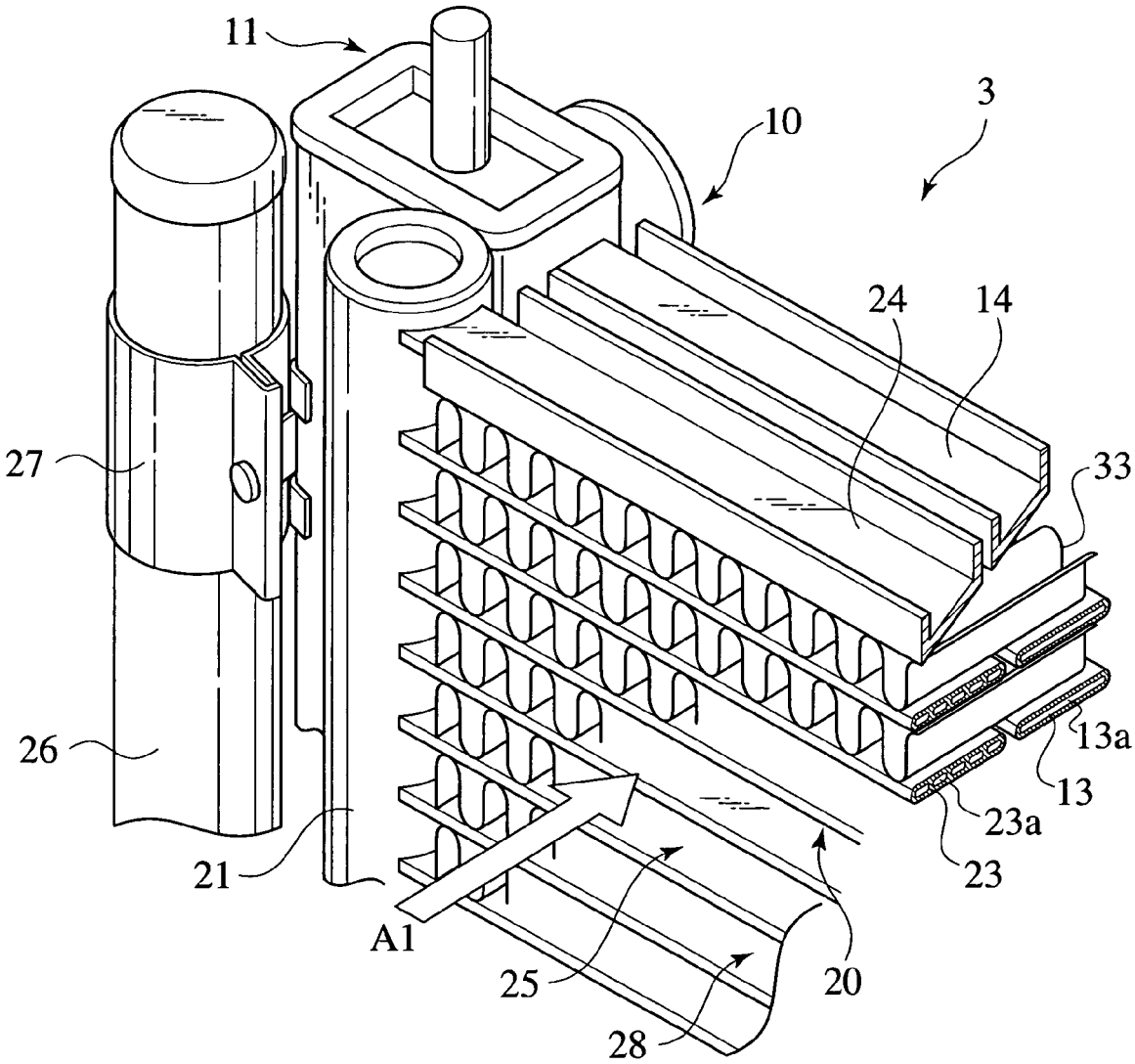
FIG. 4 is an enlarged partial perspective view of a primary portion of the vehicle heat exchanger according to a third embodiment.

With reference to FIG. 4, a vehicle heat exchanger 3 includes outer fins 33 which extend transversely over flat tubes 13 and 23. The outer fins 33 extend between the front ends of tubes 23 and the rear ends of tubes 13. The outer fins 33 are brazed on the tubes 13 and 23.

The radiator 10 and condenser 20 have common outer fins 33. The outer fins 33 fix the radiator 10 and condenser 20 integrally to each other.

The fixing of radiator 10 and condenser 20 to each other by the outer fins 33 improves operability during assembling of the vehicle heat exchanger 3 to a vehicle body.

Fourth Embodiment

Figure 5:
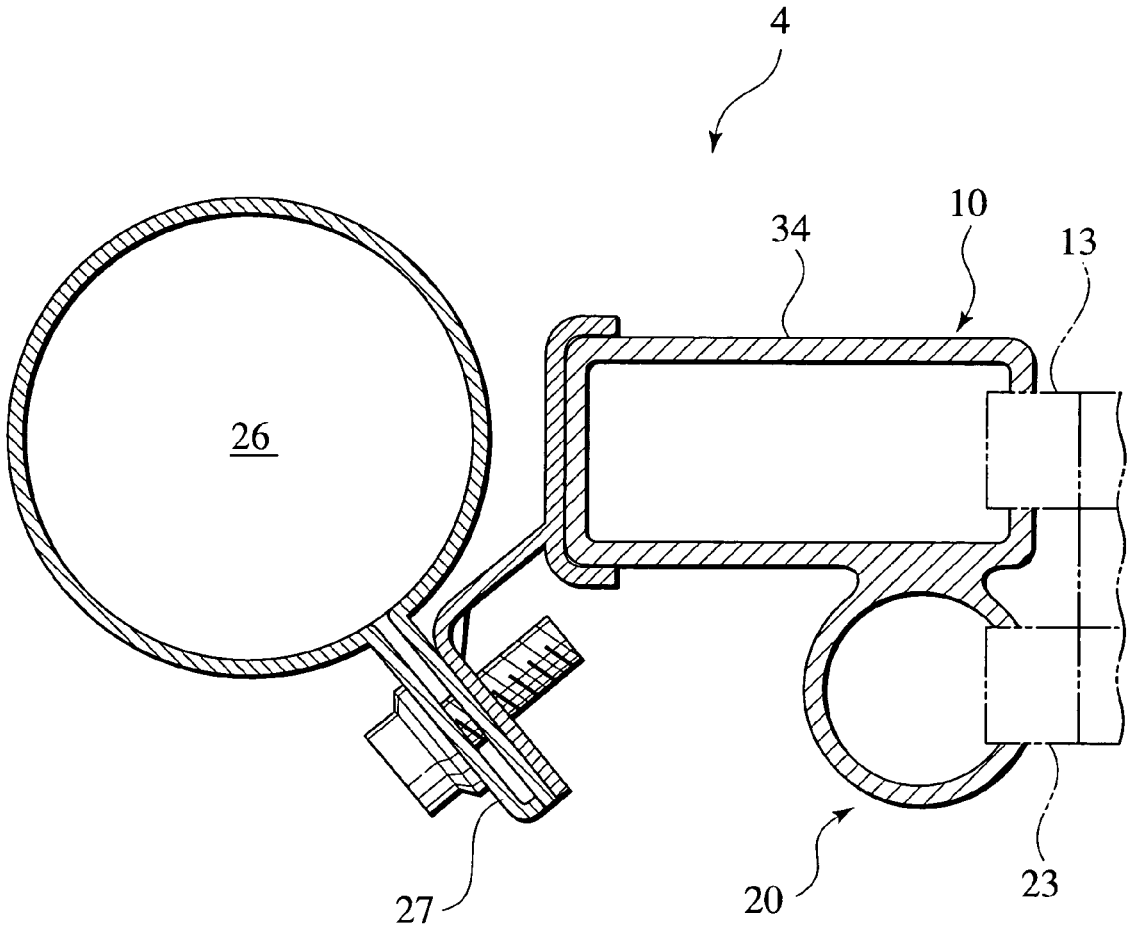
FIG. 5 is an enlarged partial perspective view of a primary portion of the vehicle heat exchanger according to a fourth embodiment.

With reference to FIG. 5, a heat exchanger 4 has a header pipe 34. The radiator 10 and condenser 20 have the neighboring header pipes 34 formed integrally with each other, with the radiator 10 and condenser 20 overlapped with each other. This improves operability during assembling of the vehicle heat exchanger 4 to a vehicle body.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A vehicle heat exchanger comprising;

a large heat exchanger and a frontmost heat exchanger overlapped with each other in a direction of airflow, each heat exchanger comprising:

heat exchanger tubes arranged side by side with each other;

outer fins interposed between neighboring heat exchanger tubes; and header pipes connecting and communicating with both ends of the heat exchanger tubes for heat-conducting media to circulate through the heat exchanger tubes and the header pipes;

a reservoir in communication with one of the header pipes for reserving one of the heat-conducting media; and a bracket for fixing the reservoir to the header pipe of the larger heat exchanger, wherein a length of the header pipes of the larger heat exchanger is longer than a length of the header pipes of the frontmost heat exchanger in an elongation direction of the heat exchanger tubes, wherein the reservoir is located behind a plane extending through an intake of the frontmost heat exchanger, wherein the airflow is introduced into the intake, and wherein the reservoir is located alongside the header pipe of the larger heat exchanger, and wherein the bracket extends toward the frontmost heat exchanger in an area beyond the overlap between the larger heat exchanger and the frontmost heat exchanger.

2. The vehicle heat exchanger of claim 1, wherein the larger heat exchanger serves as a radiator configured to cool an engine-coolant water as a heat-conducting medium, and wherein the frontmost heat exchanger serves as a condenser configured to cool a refrigerant as a heat-conducting medium.

3. The vehicle heat exchanger of claim 1, wherein the neighboring heat exchangers have header pipes having ends fixed to each other by a patch end.

4. The vehicle heat exchanger of claim 1, wherein the heat exchangers have ends in a direction that the heat exchanger tubes are stacked, respectively and the ends are fixed to each other by a side plate.

5. The vehicle heat exchanger of claim 1, wherein the heat exchangers have a common outer fin fixing the heat exchangers to each other.

6. The vehicle heat exchanger of claim 1, wherein respective one of the neighboring heat exchangers includes corresponding one of header pipes integral with each other.

7. The vehicle heat exchanger of claim 1, wherein the bracket comprises a contact member that contacts the header pipe of the larger heat exchanger beyond the overlap between the larger and frontmost heat exchanger and a screw member screw-engaged with the contact member.

8. A heat exchanger assembly comprising:

a condenser configured to introduce an airflow from an intake thereof and configured to condense a refrigerant of a vehicle air-conditioner by the airflow;

a radiator located at the back of the condenser in a direction of the airflow and configured to cool an engine coolant by the airflow; and a reservoir fixed to the radiator and located behind a plane extending through the intake of the condenser for reserving the refrigerant condensed by the condenser; and a bracket for fixing the reservoir to a header pipe of the radiator, wherein the bracket extends toward the condenser beyond an overlap between the radiator and the condenser, wherein the reservoir is located alongside the header pipe of the radiator.

9. The vehicle heat exchanger of claim 8, wherein the bracket comprises a contact member that contacts the header pipe of the radiator beyond the overlap between the radiator and the condenser and a screw member screw-engaged with the contact member.

* * * * *